US007178635B2

(12) United States Patent
Meissner et al.

(10) Patent No.: US 7,178,635 B2
(45) Date of Patent: Feb. 20, 2007

(54) ELEVATOR CONTROL HAVING INDEPENDENT SAFETY CIRCUITS

(75) Inventors: Wolfgang Meissner, Neuhausen (DE); Walter Nuebling, Ostfildern (DE)

(73) Assignee: ThyssenKrupp Elevator AG, Duesseldorf (DE)

( * ) Notice: Subject to any disclaimer, the term of this patent is extended or adjusted under 35 U.S.C. 154(b) by 0 days.

(21) Appl. No.: 11/258,594

(22) Filed: Oct. 24, 2005

(65) Prior Publication Data

US 2006/0175135 A1 Aug. 10, 2006

Related U.S. Application Data

(63) Continuation of application No. PCT/EP03/004487, filed on Apr. 30, 2003.

(51) Int. Cl.
*B66B 9/00* (2006.01)

(52) U.S. Cl. ..... 187/249; 187/391; 187/314

(58) Field of Classification Search ..... 187/313, 187/316, 317, 391, 393, 336, 339, 249, 314
See application file for complete search history.

(56) References Cited

U.S. PATENT DOCUMENTS 1,973,920 A 9/1934 Wilson
5,387,769 A * 2/1995 Kupersmith et al. ..... 187/248
5,817,994 A * 10/1998 Fried et al. ..... 187/391
6,173,814 B1 * 1/2001 Herkel et al. ..... 187/288
6,223,861 B1 * 5/2001 Sansevero ..... 187/316
6,467,585 B1 * 10/2002 Gozzo et al. ..... 187/391
6,550,585 B2 * 4/2003 Schoppa et al. ..... 187/391
6,603,398 B2 * 8/2003 Tinone et al. ..... 340/541
6,732,839 B2 * 5/2004 Schuster ..... 187/391

OTHER PUBLICATIONS

*Patent Abstracts of Japan*, vol. 2003, No. 01, Method and Device for Controlling Operation of Elevator System, Publication No. 2002255460, Publication Date Sep. 11, 2002.

* cited by examiner

*Primary Examiner*—Jonathan Salata
(74) *Attorney, Agent, or Firm*—Lipsitz & McAllister, LLC

(57) ABSTRACT

An elevator installation with at least one shaft having a plurality of shaft doors is provided. At least two cars disposed one above the other travel up and down in the shaft. Each car has at least one car door. A safety device is provided for blocking the travel of the cars when the shaft doors or car doors are open. The safety device has at least two independent safety circuits, each having at least one shaft door and/or car door associated with it. Travel of at least one car can be blocked by means of the safety circuits.

25 Claims, 3 Drawing Sheets

ELEVATOR CONTROL HAVING INDEPENDENT SAFETY CIRCUITS

This application is a continuation of international application number PCT/EP2003/004487 filed on Apr. 30, 2003.

The present disclosure relates to the subject matter disclosed in international application number PCT/EP2003/004487 of Apr. 30, 2003, which is incorporated herein by reference in its entirety and for all purposes.

BACKGROUND OF THE INVENTION

The invention relates to an elevator installation with at least one shaft, in which at least two cars disposed one above the other can be made to travel up and down, the shaft having a plurality of shaft doors and the cars respectively comprising at least one car door, and with a safety device for blocking the travel of the cars when the shaft doors or car doors are open.

The invention also relates to a method for controlling an elevator installation with at least one shaft, in which at least two cars disposed one above the other can be made to travel up and down, the shaft having a number of shaft doors and the cars respectively comprising at least one car door, and it being possible for the travel of the cars to be blocked by means of a safety device when the shaft door or car door is open.

In the effort to increase the handling capacity of elevator installations, it is proposed in U.S. Pat. No. 1,973,920 to make two cars travel up and down in a shaft along a common traveling path. The elevator installation has in this case a safety device, with the aid of which it can be ensured that the travel of the two cars is blocked if a car door or a shaft door is opened. For this purpose, monitoring elements which form series-connected switching contacts are disposed at all the shaft doors and car doors. If one of these switching contacts is opened on account of a shaft door or car door being opened, the supply voltage to both the cars is interrupted and consequently their travel is blocked.

In the case of the cited elevator installation, the lower car is carried on the upper car. This has the consequence that both cars stop simultaneously and start up again simultaneously. If a car door and a shaft door are opened for the loading or unloading of a car, the travel of both cars is blocked by means of the safety device coming into use; since, however, both cars carry out a stop simultaneously, this blockage has no influence on the traffic flow of the elevator installation.

There are also known elevator installations in which two cars can be made to travel up and down independently of one another in a shaft. In the case of such a configuration, it must be ensured by a suitable mode of operation that both cars can be braked and stopped if even only one car is to be loaded or unloaded, since otherwise, when the car door and an associated shaft door of one car open, an emergency stop would be triggered in the case of the other car on account of the safety device coming into use. This would have the consequence of a considerable risk of injury to the passengers of the other car. The stopping of one of the cars consequently leads to hindrance of the travel of the other car. This ultimately has the consequence that the transporting capacity of the elevator installation is restricted.

It is an object of the present invention to develop an elevator installation and a method for controlling an elevator installation of the type stated at the beginning in such a way that the transporting capacity of the elevator installation can be increased and the cars hinder one another as little as possible.

SUMMARY OF THE INVENTION

This object is achieved in the case of an elevator installation of the generic type according to the invention by the safety device having at least two independent safety circuits, each having at least one shaft door and/or car door associated with it, it being possible for the travel of at least one car to be blocked by means of the safety circuits.

The invention incorporates the idea that mutual hindrance of the cars can be reduced by using at least two safety circuits which each independently of one another can block the travel of at least one car. This allows the control of the cars to be decoupled with regard to the state of the car doors and shaft doors, so that, if appropriate, only the travel of one car is blocked, while the other car can continue its travel undisturbed. In particular, it can be ensured that the opening of car doors and shaft doors when one car stops does not necessarily lead to the travel of another car being adversely affected.

It may be provided, for example, that the shaft has at least one shaft region in which the shaft doors are associated only with one safety circuit. If one of these shaft doors is opened, only the travel of cars that are coupled to this safety circuit is blocked. As a result, the travel of cars which can be made to travel in different shaft regions can be decoupled in a simple way. In particular, it may be provided that the shaft is subdivided in the vertical direction into a plurality of shaft regions, for example into an upper shaft region and a lower shaft region. If a shaft door is opened in the upper shaft region, this merely has the consequence that the safety circuit associated with this shaft door responds, so that the cars that are coupled to this safety circuit are blocked in their travel, but not the cars that have no coupling with respect to this safety circuit.

It may also be provided that shaft regions respectively associated with only one safety circuit overlap one another in the vertical direction, the individual shaft regions having respectively separate shaft doors associated with them, so that opening of these shaft doors respectively has the consequence that the associated safety circuit responds. Such a configuration provides in particular the possibility of making the cars each have different shaft doors associated with them, so that the opening or closing of the shaft doors that are associated with the one car does not have the consequence of blocking the travel of the other car.

It may also be provided that the shaft has at least one shaft region in which the shaft doors are associated with at least two safety circuits. If a shaft door is opened in such a shaft region, this has the consequence that at least two safety circuits, which may be respectively coupled to different cars, respond.

It is of particular advantage if the car doors of a car are associated with only one safety circuit. As a result, it can be ensured in a constructionally simple way that, when a car door is opened, only the safety circuit associated with this car responds, while the other safety circuits remain uninfluenced by this.

In the case of a particularly preferred embodiment of the elevator installation according to the invention, it is provided that at least one upper car can be made to travel in an upper shaft region having shaft doors and that at least one lower car can be made to travel in a lower shaft region having shaft doors, the car doors of the at least one upper car and the shaft doors of the upper shaft region being associated with one or more first safety circuits and the car doors of the at least one lower car and the shaft doors of the lower shaft region being associated with one or more second safety circuits. Such a configuration has the advantage that, within a shaft, two cars can be made to travel independently of one another in an upper shaft region and a lower shaft region, respectively, and do not hinder one another in their travel.

It has proven to be advantageous if at least one safety circuit forms a shaft-door safety circuit that only has shaft doors associated with by means of the shaft-door safety circuit only to block the travel of cars in whose serving region the associated shaft doors are disposed. The "serving region" of a car is to be understood here as meaning the region of the shaft that can be traveled to by a car. If the safety device has a shaft-door safety circuit, this safety circuit responds only to opening of shaft doors and can then only block the travel of those cars in whose serving region the shaft doors associated with this shaft-door safety circuit are disposed.

It is of advantage if at least one safety circuit forms a car-door safety circuit that only has car doors associated with it, it being possible by means of the car-door safety circuit only to block the travel of cars whose car doors are associated with the car-door safety circuit. The at least one car-door safety circuit responds only to opening of the associated car doors, while the opening of a shaft door has no influence on the car-door safety circuit.

It is advantageous if each car-door safety circuit respectively has only the car doors of one car associated with it. If a car door is opened, this has the consequence in the case of such a configuration that only the car-door safety circuit associated with this car responds, while the car-door safety circuits of the other cars remain uninfluenced by this.

In the case of a particularly preferred embodiment, each car has a single car-door safety circuit and a single shaft-door safety circuit ass Such a configuration makes particularly simple control of the elevator installation possible, allowing a high transporting capacity to be achieved, since the cars hinder one another only little. The car-door safety circuit respectively associated with a car monitors merely the state of its own car doors and the associated shaft-door safety circuit may be configured in such a way that it only responds to the opening of the shaft doors disposed in the serving region of this car.

In the case of a constructionally particularly simple configuration of the elevator installation according to the invention, it is provided that the car-door and shaft-door safety circuits respectively associated with a car have monitoring elements, for example switching contacts, which are connected in series with one another. It can be ensured by the series connection, for example, that the travel of the car is blocked as soon as one of its car doors or one of the shaft doors situated in its serving region is opened.

It is advantageous if at each shaft door there is disposed for each car traveling to this shaft door an own shaft-door monitoring element. This provides the possibility of connecting in series with one another the shaft-door monitoring elements, for example switching contacts, that are respectively associated with a shaft-door safety circuit of a car, it being possible for the series connections of switching contacts that are associated with the shaft-door safety circuits of different cars to be electrically separate from one another.

It may be provided that the serving regions of the cars that can be made to travel in a shaft are separated from one another, so that no serving region has shaft doors that can be traveled to by another car. To achieve a high transporting capacity, however, it may be of advantage if the serving regions of the cars have an overlap in such a way that at least one of the shaft doors can be traveled to both by a first car and by at least one second car. In this case it is advantageous if the travel of each car can be blocked by a shaft-door safety circuit which has associated with it both at least one shaft door that is disposed in the serving region of only this one car and at least one shaft door that is disposed in the serving region of this one car and at least one other car.

It is of particular advantage if, when a car is stopped in the region of a shaft door, the monitoring of the opening and closing state of this shaft door can be disabled. It can be ensured by such a configuration that the opening of a shaft door when a car stops does not lead to a safety circuit responding and, as a result, possibly the travel of another car being blocked. Rather, on the operational opening of a shaft door, its monitoring is disabled. The "operational opening" of a shaft door is understood here as meaning the opening of a shaft door when a car enters the shaft-door region with the intention of door opening. In just the same way as the opening of the car door, the opening of the shaft door may already take place here just before the flush position of the car with the shaft door is reached, for example already at a distance of approximately +/−0.3 m, if the car has a speed of less than approximately 0.8 m/s. The opening of the shaft door usually takes place here under the action of the opening movement of the car door, i.e., when a car stops, at least one door of the car is coupled to the shaft door, so that, with the car door, the shaft door is also opened. On account of the possibility of disabling the monitoring of this shaft door, the travel of the other cars within the shaft is consequently not adversely affected by the stopping of one car.

The monitoring of the opening and closing state can preferably only be disabled by those shaft doors that are disposed in the serving region of at least two cars. The monitoring of shaft doors that are merely disposed in the serving region of a single car cannot be disabled, however, in the case of such a configuration of the elevator installation. This provides the possibility of checking the response of the safety circuit coupled to a car by traveling to and opening a shaft door for which the monitoring cannot be disabled.

The monitoring of the opening and closing state of the shaft doors and car doors preferably takes place with the aid of monitoring elements of the safety device that respectively interact with a shaft door or car door. Switching contacts which can be actuated by opening of the associated shaft door or car door may be used for example as monitoring elements. In this case, with-contact or contactless actuation of the switching contacts may be provided. For example, it may be provided that the shaft doors and car doors are mechanically coupled to the switching contacts; alternatively or additionally, an inductive or capacitive coupling may be provided, or else a coupling by means of infrared or light radiation.

It is advantageous if the monitoring elements of shaft doors for which the monitoring can be disabled can be rendered ineffective, for example bridged, by means of a bridging unit. The bridging unit may be disposed at the shaft door or else at one or more cars. It is of particular advantage if the bridging unit has an activating element, which can be actuated by a car stopping at the associated shaft door. If a car enters the region of the shaft door with the intention of opening the door, it can actuate the activating element of the bridging unit for bridging the monitoring elements associated with the shaft door. The actuation of the activating element may take place with contact or else contactlessly. It may be provided, for example, that the activating element is configured as a magnetic switch which can be actuated by being approached by the car.

For controlling the operation of the elevator installation, the latter comprises an installation control, which is preferably coupled to input elements disposed outside the shaft for the input of a destination call by a passenger. The travel destination of the car can be inputted into the elevator control, and in this respect it is of particular advantage if the bridging units used for disabling the monitoring of the shaft doors can be activated by the elevator control. This provides the possibility of activating the bridging units of a shaft door whenever the car is made to stop at this shaft door by the elevator control.

As already explained, it may be provided that the bridging units can be enabled by actuation of their activating elements by means of a car. In this respect it is particularly advantageous if the bridging units can only be activated by actuation of their activating elements whenever they are at the same time acted upon by a control signal provided by the installation control. The bridging units are consequently configured in a two-channel form, both channels having to be simultaneously effective to disable the monitoring of the respectively associated shaft door. A first channel of the bridging unit is controlled by the respective activating element, which interacts with a car stopping in the region of the shaft door, while a second channel of the bridging unit is activated by the installation control. Only in the case in which a control signal of the installation control is present and the activating element is at the same time actuated by the car is the monitoring of the shaft door disabled.

It is of advantage if, when a shaft door is opened without a car being present at the stop corresponding to the shaft door, all the shaft-door safety circuits associated with this stop are responsive.

For supplying energy to the driving and controlling elements of the cars, in the case of a preferred embodiment each car is connected to a separate voltage supply unit. In this respect it is advantageous if the car-door and shaft-door safety circuits of each car, that is to say the car-door and shaft-door safety circuits into which the respective car is incorporated, are connected to the respective voltage supply unit of the car, shaft-door safety circuits with shaft doors that are disposed in the serving region of at least two cars only being able to be connected to the voltage supply unit of one of the cars concerned.

It has proven to be advantageous in this respect that the shaft-door safety circuits that have their associated shaft doors disposed in the serving region of a number of cars can be automatically connected in each case to the voltage supply unit of a pre-selected car, as long as this car is in operation. In the case of such a configuration, the shaft-door safety circuits that have their shaft doors disposed in the serving region of a plurality of cars are connected to a preferred voltage supply unit, the voltage supply unit being that of one of the cars traveling to the shaft doors. However, the connection only exists when this car is in operation. If this car is taken out of operation, the shaft-door safety circuits in question are automatically connected to the voltage supply unit of another of the cars traveling to the shaft doors. As a result, it can be ensured in a constructionally simple way that, for example for maintenance and repair work, the voltage supply unit of a car can be switched off, and the latter consequently taken out of operation, without the shaft-door safety circuits that have their associated shaft doors disposed in the serving region of both this car and of another car being adversely affected in their function hereby.

The configuration of the elevator installation according to the invention ensures that non-operational opening of shaft doors has the consequence of hindering the travel of all the cars in the shaft in the serving region of which the opened shaft door lies. However, the opening of shaft doors does not represent the only safety-relevant event that can influence the travel of a car. The elevator installation according to the invention may have further safety-relevant switching members with the aid of which the operating states of the elevator installation can be monitored. For example, it may be provided that, if two cars are coming too close together, the elevator installation can influence the travel of at least one of the cars, for example brake or accelerate it. It is particularly advantageous in this respect if each car has a shaft monitoring circuit associated with it, by means of which the travel of the car can be blocked in dependence on the state of safety-relevant switching members, at least one switching member having a bridging element associated with it for rendering the switching member ineffective, it being possible for the travel of at least one second car to be blocked when a first car is traveling with an active associated bridging element. Such a configuration of the elevator installation according to the invention is distinguished by the fact that at least one safety-relevant switching member can be rendered ineffective, for example bridged, by means of a bridging element, it being ensured, however, that, when the first car is traveling with an active bridging element, the travel of at least one second car can be blocked. Consequently, a safety-relevant switching member, for example a proximity switch, can be selectively rendered ineffective, in order to bring two cars very close together deliberately, a responding proximity switch indeed forming a safety-relevant switching member but it being possible for it to be selectively rendered ineffective, for example bridged. When the two cars move away from one another again, the bridging is to be disabled again. To ensure that such bridging is not unintentionally retained, for example on account of a fault, it is provided according to the invention that, when a first car is traveling with an active associated bridging element, the travel of at least one second car can be blocked. This ensures that transport by means of the elevator installation is still possible even when a bridging element is damaged, although transport can only be performed by means of the one car, while the travel of the other car is blocked in order to avoid any risk of an accident being caused by the defective bridging of the safety-relevant switching member. Instead of bridging, some other form of rendering the switching member ineffective is also conceivable, for example by removal of the voltage supply.

It is advantageous in this respect if the blockage of the second car can be canceled by means of the elevator control. This provides the possibility for example of canceling the blockage within the region of a specific shaft door, so that the second car can be aligned flush within the shaft door region, but cannot leave the region of the shaft door.

As mentioned at the beginning, the invention also relates to a method for controlling an elevator installation with at least one shaft, in which at least two cars disposed one above the other can be made to travel up and down, the shaft having a plurality of shaft doors and the cars respectively comprising at least one car door, and it being possible for the travel of the cars to be blocked by means of a safety device when the shaft door or car door is open.

To achieve a particularly high transporting capacity with greatest possible availability of the elevator installation, it is provided according to the invention in the case of such a method that the travel of each car is separately blocked in dependence on the opening and closing states of its car doors and of all the shaft doors and in dependence on the position of all the cars that can be made to travel along the shaft.

The method according to the invention is distinguished in particular by the fact that, after checking the states of the individual car doors, the positions of the individual cars and the states of the shaft doors, the travel of the individual cars is released or blocked. If, for example, an upper car is located in an upper shaft region, while a lower car assumes a position in a lower shaft region, the travel of the lower car can be released even when a shaft door is open in the upper shaft region, provided that this shaft door lies outside the serving region of the lower car. If, however, it is established that a shaft door is opened within the serving region of the lower car, the travel of the lower car is blocked unless the opening of this shaft door takes place operationally by the upper car.

The method according to the invention has the advantage that the travel of the cars that can be made to travel within the shaft is hindered as little as possible and, as a result, the transporting capacity of the elevator installation can be increased.

The following description of preferred embodiments of the invention serves for further explanation in conjunction with the drawings.

DETAILED DESCRIPTION OF THE INVENTION

Figure 1:
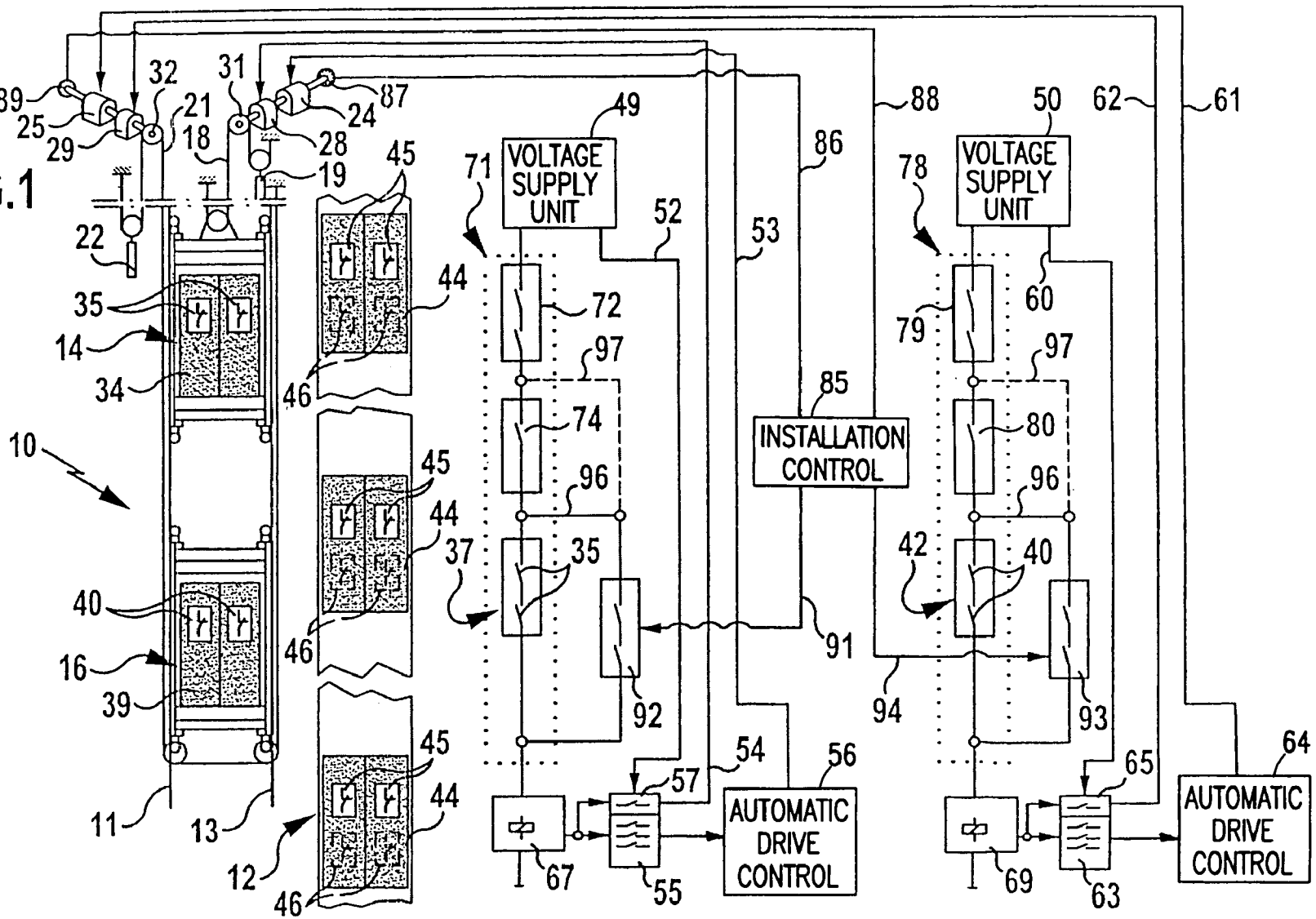
FIG. 1 shows a schematic representation of a first embodiment of an elevator installation according to the invention.
Figure 2:
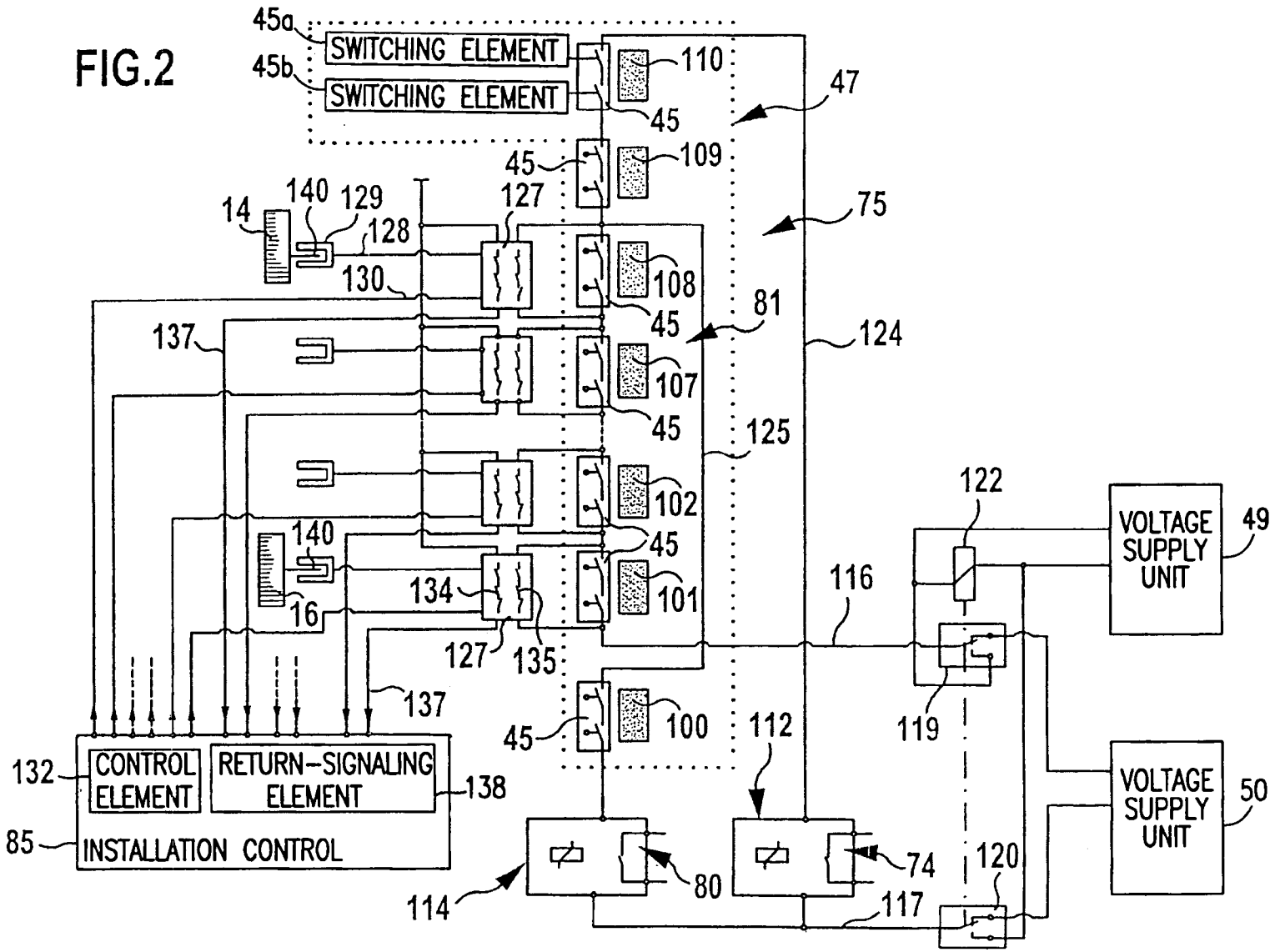
FIG. 2 shows a schematic representation of a shaft-door safety unit of the elevator installation from FIG. 1.

In FIGS. 1 and 2, a first embodiment of an elevator installation according to the invention is represented in a greatly schematized form and designated overall by the reference numeral 10. It comprises two cars disposed one above the other in a shaft 12, specifically an upper car 14 and a lower car 16, which can be made to travel individually up and down along a common traveling path on guides 11, 13. To achieve a better overview, in the drawing the shaft 12 is shown offset in relation to the two cars 14 and 16.

The upper car 14 is coupled to a counterweight 19 via a suspension cable 18, and the lower car 16 is coupled to a counterweight 22 via a suspension cable 21. Each car 14 and 16 has a separate drive associated with it in the form of an electric drive motor 24 and 25, respectively, and in each case a separate brake 28 and 29, respectively. The drive motors 24 and 25 in each case drive a traction sheave 31 and 32, respectively, over which the suspension cables 18 and 21 are led.

The upper car 14 has a car door 34 with two door leaves, the opening and closing state of which is monitored by monitoring means, in the exemplary embodiment represented by switching elements 35. The switching elements 35 have electrical contacts, which are closed when the associated car door 34 is closed. The electrical contacts of the switching elements 35 are open when the associated car door 34 is not closed. All the switching elements 35 of the upper car 14 are connected in series with one another and form a car-door safety circuit 37, explained below, of the upper car 14.

In a corresponding way, the lower car 16 has a car door 39 with two door leaves, the opening and closing state of which is monitored by monitoring means in the form of electrical switching elements 40. The switching elements 40 have electrical switching contacts, which are closed when the associated car door 39 is closed. The electrical contacts of the switching elements 40 are open when the associated car door 39 is not closed. All the switching elements 40 of the lower car 16 are connected in series with one another and form a car-door safety circuit 42, explained in more detail below, of the lower car 16.

At each stop at which access to one of the cars 14, 16 is possible, the shaft 12 has in each case at least one shaft door 14, which in the embodiment represented comprises two door leaves. The opening and closing state of the shaft doors 44 is monitored by respectively associated monitoring means, which have electrical contacts. Each shaft door 44 additionally has blocking means, for example hook bolts, with signaling contacts. The monitoring means and blocking means are hereafter referred to together as switching elements 45. The electrical contacts of the switching elements 45 are closed when the associated shaft door 44 is closed and locked; the contacts are open when the associated shaft door 44 is not closed or not locked. The interconnection of the electrical contacts of all the switching elements 45 of all the shaft doors 44 forms a shaft-door safety unit 47, which is explained in more detail below and represented in FIG. 2.

If a car 14, 16 enters a stop that can be served by it, in order to be loaded or unloaded there, the car door 34 or 39 is then opened in the unlocking region of the stop in a way which is known per se and therefore not represented, for example by means of an electrical door drive. In a way which is likewise known to a person skilled in the art and therefore not represented, to achieve a better overview in the present case, when a stop is entered a mechanical coupling takes place between the car door 34 or 39 and the shaft door 44 of the stop entered by the corresponding car 14, 16. The movement of the opening car door 34 or 39 has the effect that the coupled shaft door 44 is unlocked and, in synchronism with the car door 34 or 39, likewise opens. The closing operation also takes place in a corresponding way, the shaft door 44 subsequently being locked in the closed position and the mechanical coupling between the car door 34 or 39 and the shaft door 44 being canceled again.

Each car 14 and 16 has associated with it a separate voltage supply unit 49 and 50, respectively, which undertakes the voltage supply to all the controlling and driving components associated with the respective car 14 or 16. In particular, the electrical drive motors 24 and 25 and the brakes 28 and 29 of each car 14, 16 are supplied with electrical energy by the respectively associated voltage supply unit 49 or 50. For this purpose, the voltage supply unit 49 is in electrical connection with the drive motor 24 via an electrical supply line 52 and a first current path 53 and with the brake 28 of the upper car 14 via the electrical supply line 52 and a second current path 54, a first contact block 55 and an automatic drive control 56 being connected between the electrical supply line 52 and the first current path 53, and a second contact block 57 being connected between the electrical supply line 52 and the second current path 54.

In a corresponding way, the voltage supply unit 50 of the lower car 16 is connected to the associated drive motor 25 via an electrical supply line 60 and also a first current path 61 and to the associated brake 29 via the electrical supply line 60 and a second current path 62, a first contact block 63 and an automatic drive control 64 being connected between the electrical supply line 60 and the first current path 61, and a second contact block 65 being connected between the electrical supply line 60 and the second current path 62.

The first and second contact blocks 55, 57 and 63, 65 respectively associated with a car 14 or 16 can be electrically actuated by a travel contactor 67 or 69 associated with the respective car 14 or 16. The first and second contact blocks 55, 57, associated with the upper car 14, in this case form the contactor contacts of the travel contactor 67, and the first and second contact blocks 63, 65, associated with the lower car 16, form the contactor contacts of the travel contactor 69.

The voltage supply to the travel contactor 67 takes place via a safety chain 71, which is associated with the upper car 14 and via which the travel contactor 67 is connected to the voltage supply unit 49 of the upper car 14. The safety chain 71 is formed by a shaft monitoring circuit 72, associated with the upper car 14, the output contacts 74 of a shaft-door safety circuit 75, associated with the upper car 14 and explained in more detail below, and also the car-door safety circuit 37. The shaft-door monitoring circuit 72, the output contacts 74 and the car-door safety circuit 37 are connected in series with one another. The shaft monitoring circuit 72, associated with the upper car 14, is configured here in a way known per se; it includes all the safety switches that are associated with the upper car 14 and are to be incorporated in a safety loop, such as for example emergency limit switches, safety gear switches, buffer switches and the like. Not incorporated in the shaft monitoring circuit 72, however, are the switching elements 35 of the car doors 34 of the upper car 14 and the switching elements 45 of all the shaft doors 44.

A current flow from the voltage supply unit 49 to the travel contactor 67 only comes about when all the electrical contacts of the safety chain 71 that are involved in the current flow are closed. The current flow is interrupted as soon as only one contact involved in the current flow is open. If all the contacts of the safety chain 71 are closed, the brake 28 of the upper car 14 is supplied with electrical energy by the voltage supply unit 49 via the electrical supply line 52 and the second current path 54, so that the brake 28 is open. At the same time, the drive motor 24 of the upper car 14 is supplied with electrical energy by the voltage supply unit 49 via the electrical supply line 52 and the first current path 53, and can consequently be set in rotation in order to move the car 14. An interruption of the current flow via the safety chain 71 to the travel contactor 67 has the consequence that the first and second contact blocks 55, 57 are opened and, as a result, the energy supply to the brake 28 and to the drive motor 24 is interrupted. This has the effect that no electrical drive energy is available any longer to the drive motor 24 and that the brake 28 engages, so that the drive shaft of the drive motor 24 is braked and, as a result, the car 14 comes to a stop.

The travel contactor 69 associated with the lower car 16 is connected via a safety chain 78 of the lower car 16 to the voltage supply unit 50 of the latter. The safety chain 78 is configured in a way corresponding to that of the safety chain 71; it has a shaft monitoring circuit 79 that is known to a person skilled in the art and is connected in series with output contacts 80 of a shaft-door safety circuit 81, associated with the lower car 16 and explained in more detail below, and also with the switching elements 40 of the car-door safety circuit 42 of the lower car 16.

The shaft monitoring circuit 79 is formed in a way corresponding to that of the shaft monitoring circuit 72. It includes all the safety switches that are associated with the lower car 16 and are to be incorporated in a safety loop, for example emergency limit switches, safety gear switches, buffer switches and the like. Not incorporated in the shaft monitoring circuit 79, however, are the switching elements 40 of the car doors 39 of the lower car 16 and the switching elements 45 of all the shaft doors 44.

A current flow from the voltage supply unit 50 to the travel contactor 69 only comes about when all the electrical contacts of the safety chain 78 that are involved in the current flow are closed. The current flow is interrupted as soon as only one contact involved in the current flow is open. If a current flow comes about, the associated first and second contact blocks 63, 65 are closed by the travel contactor 69, so that the brake 29 is connected to the voltage supply unit 50 via the electrical supply line 60 and the second current path 62 and opens as a result, and the drive motor 25 is supplied with electrical energy via the electrical supply line 60 and the first current path 61 and is set in rotation as a result, in order to move the lower car 16. The rotational speed of the drive motor 25 can in this case be controlled in a way known per se by the automatic drive control 64, which may be configured for example in the form of a frequency converter.

The automatic drive control 56 associated with the upper car 14 permits a corresponding automatic control of the rotational speed of the drive motor 24 and may likewise be configured as a frequency converter.

If the current flow from the voltage supply unit 50 via the safety chain 78 to the travel contactor 69 is interrupted, the contacts of the first and second contact blocks 63 and 65 are opened, i.e. the energy supply to the drive motor 25 and the brake 29 is interrupted. This has the consequence that the brake 29 engages and consequently the drive shaft of the drive motor 25 is braked and, as a consequence, the lower car 16 is brought to a stop.

The elevator installation 10 has an installation control 85, which is connected via a signal line 86 to an encoder 87, which is mounted in a rotationally fixed manner on the drive shaft of the drive motor 24 of the upper car 14 and provides the installation control 85 with displacement pulses, from which the installation control 85 can determine the position of the upper car 14 in the customary way. Via a further signal line 88, the installation control 85 is in electrical connection with an encoder 89, which is mounted in a rotationally fixed manner on the drive shaft of the drive motor 25 of the lower car 16 and provides the installation control 85 with displacement pulses, from which the installation control 85 can determine the position of the lower car 16 in the customary way.

The installation control 85 is in electrical connection via a first control line 91 with a first bridging circuit 92, which is associated with the upper car 14, is connected in parallel with the car-door safety circuit 37 and can be controlled by the installation control 85.

Used for bridging the car-door safety circuit 42 associated with the lower car 16 is a second bridging circuit 93, which is connected to the installation control 85 via a second control line 94.

The bridging of the car-door safety circuits 37 and 42 by means of the first and second bridging circuits 92 and 93, respectively, makes it possible when a stop is entered for the car doors 34 and 39 to be opened in the unlocking region of this stop even before the car 14 or 16 has reached the level at which it is flush with the respective stop, so that the car 14 or 16 can reach the flush level with the car doors 34 or 39 already open. As already explained, opening of the car doors 34 or 39 has the consequence that the car-door safety circuit 37 or 42 is opened. The interruption of the current flow to the travel contactor 67 or 69 can be prevented, however, by means of the first or second bridging circuit 92 or 93 if a control signal is provided by the installation control 85 in dependence on the respectively ascertained position of the upper or lower car 14, 16. Activation of the bridging circuit 92 or 93 means that its electrical contacts are closed and consequently the bridging is active. Consequently, an open car-door safety circuit 37 or 42 no longer leads to an interruption of the current flow to the associated travel contactor 67 or 69. If, however, the associated bridging circuit 92 or 93 is not activated by the installation control 85, its contacts are open and consequently the bridging is not active.

The locations of the cars 14 and 16 within the shaft 12 are known to the installation control 85 on the basis of the displacement pulses provided by the respective encoders 87 and 89, and the activation of the bridging circuit 92 and 93 takes place only whenever the respective car 14 or 16 is located in the unlocking region of the stop that is the travel destination.

If, when the car doors 34 or 39 are being opened while the car 14, 16 is entering the stop, the switching elements 45 of the respective shaft door 44 are also actuated, the output contacts 74 and 80 of the shaft-door safety circuit 75, 81 associated with the respective car 14 or 16 can be bridged in addition to the respective car-door safety circuit 37 or 42 by the bridging circuits 92, 93, in that the bridging circuits 92 and 93 are connected to the respective safety chain 71 or 78 not via a connecting line 96 that merely permits bridging of the associated car-door safety circuit 37 or 42, but via a connecting line 97, which is represented by dashed lines in FIG. 1, the connecting line 97 permitting not only bridging of the car-door safety circuit 37 or 42 but also bridging of the output contacts of the respective shaft-door safety circuit 75 or 81.

The shaft-door safety circuits 75 and 81 are explained in more detail below with reference to FIG. 2. In FIG. 2, the elevator installation 10 is represented in a greatly schematized form with a total of eleven stops, it being intended for the lowermost stop to be situated on the ground floor of a building and this stop having the reference numeral 100; the next-following stop is disposed on the first upper floor and is provided with the reference numeral 101. The other stops are provided with 102, etc., so that the stop on the tenth upper floor has the reference numeral 110. To achieve a better overview, the stops of the third to sixth floors are not represented in FIG. 2; however, the configuration of the corresponding stops and the electrical wiring of the corresponding components at these stops is identical to the stops 102 or 107 explained below.

In the case of the exemplary embodiment represented in FIG. 2, it is assumed that the stop 100 situated on the ground floor can only be traveled to by the lower car 16 and the two uppermost stops 109 and 110 of the ninth and tenth floors can only be traveled to by the upper car 14, while the stops 101 to 108 situated in between can be traveled to by both cars. The serving region of the lower car 16 consequently extends over the stops 100 through 108, and the serving region of the upper car 14 extends over the stops 101 to 110, and the entire shaft 12 can be subdivided into an upper shaft region with the stops 109 and 110, a common shaft region with the stops 101 to 108 and a lower shaft region with the stop 100. The stops of the lower and upper shaft regions can respectively be traveled to only by one of the two cars 14, 16, while the stops in the common shaft region can be traveled to by both cars.

In FIG. 2, all the stops 100 to 110 are shown with their respectively associated switching elements 45 of the respective shaft doors 44, all the switching elements 45 having a shaft-door contact 45*a* and a bolt contact 45*b* —this being illustrated in FIG. 2 only for the example of the switching element of the uppermost stop 110, to achieve a better overview. The shaft-door contact 45*a* is closed when the shaft door 44 is closed, and the bolt contact 45*b* is closed when the shaft door 44 is locked.

The switching elements 45 of all the shaft doors 44 form in their totality a shaft-door safety unit 47. This has a shaft-door safety circuit 75, which is associated with the upper car 14, and also a shaft-door safety circuit 81, which is associated with the lower car 16. The shaft-door safety circuit 75 associated with the upper car 14 is connected to a switching unit 112, which has the output contacts 74, and the shaft-door safety circuit 81 of the lower car 16 is connected to a switching unit 114 with the output contacts 80.

The shaft-door safety circuit 81 of the lower car 16 is formed by a series connection of the switching elements 45 of the stops 101 to 108 and of the stop 100 situated on the ground floor, while the switching elements 45 of the stops 109 and 110 situated on the ninth and tenth upper floors are not incorporated in the shaft-door safety circuit 81 of the lower car 16.

The shaft-door safety circuit 75 of the upper car 14 is formed by a series connection of the switching elements 45 of the stops 101 to 110, while the switching elements 45 of the stop 100 situated on the first floor are not incorporated in the shaft-door safety circuit 75 of the upper car 14.

The voltage supply to the shaft-door safety circuits 75 and 81 takes place via a common feed line 116 and a common return line 117, which is connected to the switching units 112 and 114 and can selectively be connected via contact blocks 119 and 120 to the voltage supply unit 49 of the upper car 14 or the voltage supply unit 50 of the lower car 16. The contact blocks 119 and 120 can be controlled by a switching contactor 122, which is connected to the voltage supply unit 49 of the upper car 14. If the upper car 14 is in operation, its voltage supply unit 49 is active. This has the consequence that the switching contactor 122 is supplied with electrical energy and the two contact blocks 119 and 120 are activated in such a way that the common feed line 116 and the common return line 117 of the two shaft-door safety circuits 75 and 81 are in electrical connection with the voltage supply unit 49. If, on the other hand, the upper car 14 is not in operation, its voltage supply unit 49 is switched off. This has the consequence that the switching contactor 122 is not supplied with electrical energy. The contact blocks 119 and 120 then assume such a switching position that the feed line 116 and the return line 117 are in electrical connection with the voltage supply unit 50 of the lower car 16. The shaft-door safety circuits 75 and 81 are consequently in any event only supplied with electrical energy by a single voltage supply unit 49 or 50, the voltage supply unit 49 of the upper car 14 preferably being used whenever this car 14 is in operation.

The current flow via the shaft-door safety circuit 75 associated with the upper car 14 takes place from the feed line 116, via the series-connected switching elements 45 of the stops 101 to 108, which can be traveled to by both cars 14 and 16, and also via the switching elements 45 of the stops 109 and 110, which can only be traveled to only by the upper car 14, and subsequently via a current path 124 to the switching unit 112 and from the latter via the return line 117 to one of the two voltage supply units 49 or 50.

The current flow via the shaft-door safety circuit 81 associated with the lower car 16 takes place from the feed line 116 via the switching elements 45 of the stops 101 to 108 which can be traveled to by both cars 14, 16 and subsequently via a current path 125 to the switching elements 45 of the lowermost stop 100 and subsequently via the switching unit 114 to the return line 117.

If the switching units 112 and 114 are supplied with electrical energy via the respectively associated shaft-door safety circuits 75 or 81, their output contacts 74 or 80 are closed. If the energy supply to the switching units 112 or 114 is interrupted, the respective output contacts 74 or 80 are opened.

The switching elements 45 of the shaft doors 44, which are disposed in the region of the stops 101 to 108 and can be traveled to by both cars 14 and 16, respectively have a separate associated bridging unit 127, which is disposed in the region of the respective stop and with the aid of which the respective switching element 45 can be rendered ineffective, to be specific electrically bridged. The identically configured bridging units 127 have in each case two control channels, in that they are in electrical connection via a first input line 128 with a fork-shaped magnetic switch 129, disposed in the region of the respective stop 101 to 108, and are connected via a second input line 130 to a control element 132 of the installation control 85.

The bridging units 127 respectively have a first series of contacts 134 and a second series of contacts 135, the switching positions of which are always identical. Each first series of contacts 134 is in electrical connection with a return-signaling element 138 of the installation control 85 via an output line 137, and the switching element 45 of the shaft doors 44 that is associated with the respective bridging unit 127 can be bridged via the second series of contacts 135.

Bridging of a switching element 45 can only take place by means of the associated bridging unit 127 whenever both the magnetic switch 129 disposed in the region of the respective stop in the shaft 12 is actuated and a control signal is provided by the control element 132 via the second input line 130. The actuation of the magnetic switch 129 takes place by means of switching lugs 140, which are fixed on the cars 14 and 16 and may be configured for example in the form of a sheet-metal strip. The mounting locations of the magnetic switches 129 in the shaft 12 in the region of the stop associated with the respective magnetic switches 129, on the one hand, and the mounting locations of a switching lug 140 respectively on the cars 14 and 16, on the other hand, are chosen such that a magnetic switch 129 can only be actuated whenever one of the two cars 14, 16 is in the unlocking region of the stop associated with the respective magnetic switch 129.

As already explained, the two series of contacts 134 and 135 are only closed whenever both control channels of the corresponding bridging unit 127 are activated simultaneously. Both series of contacts 134 and 135 are open if only one channel or none of the two channels is activated.

A closed series of contacts 135 of a bridging unit 127 bridges the switching elements 45 of all the shaft doors 44 of the associated stop. As already explained, the series of contacts 134 always has the same switching position as the series of contacts 135. This serves for return signaling of the switching position of the series of contacts 135. By means of the signals of the switching positions of the series of contacts 134, the installation control 85 is always kept informed of the switching position of all the bridging units 127 and can use this information for controlling the traffic flow of the cars 14 and 16 and, in the event of an error, intervene to correct the traffic flow.

The operating mode of the bridging units 127 in connection with the traffic flow of the cars 14 and 16 is described below by way of example for the entry of the car 16 into the stop 101 situated on the first upper floor: The car 16 is initially located outside the locking region of the stop 101 and approaches this stop with the intention of stopping at the stop 101. Once the car 16 has already reduced its speed to the extent that entry to the stop 101 can be authorized by the installation control 85, to be specific to a speed less than 0.8 m/s, and the car 16 is in the direct proximity of the unlocking region of the stop 101, to be specific at a distance of approximately 0.3 m from the flush level of this stop, the installation control 85 then activates the first channel of the associated bridging unit 127 via the second input line 130. When the car 16 reaches the unlocking position of this stop, the switching lug 140 enters the fork of the magnetic switch 129, whereby the magnetic switch 129 activates the second channel of the same bridging unit 127 via the first input line 128. Once both channels of the bridging unit 127 associated with the stop 101 have been activated, the two series of contacts 134 and 135 of the bridging unit 127 are closed. The closed series of contacts 135 thereby bridges the switching elements 45 of all the shaft doors 44 of the stop 101. The closed series of contacts 134 signals via the output line 137 to the return-signaling element 138 of the installation control 85 that the bridging of the switching elements 45 at the stop 101 has taken place. The installation control 85 then authorizes the opening of the shaft door 44 at the stop 101. Although the opening of the shaft door 44 at the stop 101 has the effect that the electrical contact of the switching element 44 is opened, because of the active bridging by means of the series of contacts 135 of the bridging unit 127 this does not lead to an interruption of the activation of the switching units 112 and 114 of the two shaft-door safety circuits 75 and 81, i.e. their output contacts 74 and 80 remain closed. In spite of the opened shaft door at the stop 101, the respective travel of the two cars 14 and 16 is consequently not influenced.

When the lower car 16 subsequently leaves the unlocking region of the stop 101, the associated magnetic switch 129 is then no longer actuated by the switching lug 140 of the lower car 16, i.e. the second channel of the bridging unit 127 is no longer activated, so that both series of contacts 134 and 135 of this bridging unit 127 are opened and consequently the bridging of the switching elements 45 at the stop 101 is canceled. If, on account of a fault, one of the shaft doors 44 of the stop 101 is still open, this leads to the immediate stopping of both cars 14 and 16.

If, however, in the case of the example explained above with bridged switching elements 45 of the stop 101, in addition a shaft door 44 is for example manually opened with the aid of an emergency unlocking key at another stop, for example at the stop 107, this leads to an interruption of the activation of the switching units 112 and 114 of the two shaft-door safety circuits 75 and 81 and consequently likewise to the immediate stopping of both cars 14 and 16.

If it is intended in the example explained above for the lower car 16, starting from the stop 101, to carry out a new trip to another stop, the activation of the first channel of the bridging unit 127 associated with the stop 101 is then ended by the installation control 85 before travel begins, so that both series of contacts 134 and 135 of this bridging unit 127 are opened and consequently the bridging of the switching elements 45 of this stop 101 is canceled. This has the consequence that new travel by the lower car 16, starting from the stop 101, can only begin when the shaft doors 44 of this stop 101 are closed.

At the stops 100 and 109, 110, which can each only be traveled to by one car 16 or 14, no bridging units 127 are installed. Bridging of the switching elements 45 of the shaft doors 44 accordingly cannot take place at these stops 100, 109 and 110. However, as a result of the interconnection of the shaft-door safety circuits 75 and 81 that is used, entering these stops 100, 109 and 110, and the opening of the shaft doors 44 of these stops 100, 109 and 110 thereby taking place, only has effects on the shaft-door safety circuit 75 or 81 that is associated with the respectively entering car 14, 16.

Thus, if the upper car 14 enters the stop 109 or the stop 110, only the activation of the switching unit 112 of the shaft-door safety circuit 75 of the upper car 14 is interrupted by the shaft door 44 opening in the region of this stop 109 or 110. This merely leads to opening of the output contacts 74, and consequently to an interruption of the safety chain 71 associated with the upper car 14, but not to an interruption of the safety chain 78 associated with the lower car 16. Immediate stopping of the upper car 14 when it enters the stops 109 or 110 can be prevented if, as represented by dashed lines in FIG. 1, the connecting line 97 is used instead of the connecting line 96. Since, as described above, the bridging circuit 92 is only effective when the upper car 14 is in the unlocking region of the associated stop which it is to enter, this measure has no safety-relevant disadvantages.

If the lower car 16 enters the stop 100, only the activation of the switching unit 114 of the shaft-door safety circuit 81 is interrupted by the opening shaft door 44. This leads to opening of the output contacts 80. The shaft-door safety circuit 75 of the upper car 14 remains uninfluenced by this and its output contacts 74 remain closed. Immediate stopping of the lower car 16 when it enters the stop 100 can be prevented by using the connecting line 97 instead of the connecting line 96, as represented by dotted lines in FIG. 1. Since, as already mentioned, the bridging circuit 93 is only effective whenever the lower car 16 is in the unlocking region of a stop which it is to enter, this measure has no safety-relevant disadvantages.

In the case of the embodiment represented in FIG. 2, a single shaft-door safety unit 47 is used, with series-connected switching elements 45 of all the shaft doors 44, and the shaft-door safety circuits 75 and 81 respectively associated with a car 14 or 16 in each case cover a sub-region of the series connection of the switching elements 45. It may alternatively also be envisaged to use two shaft-door safety units, which are electrically separate from one another and respectively comprise a shaft-door safety circuit that is assigned to a car. For this purpose, at each shaft door 44 an own switching element 45 or 46 may be disposed for each car 14, 16 traveling to this shaft door 44, the switching elements 45 and the switching elements 46 respectively forming an own series connection and consequently a separate shaft-door safety circuit. In the case of the shaft doors which can be traveled to by both cars 14 and 16, both the switching elements 45 and the switching elements 46, represented by dotted lines in FIG. 1, have in each case an associated bridging unit, which is electrically connected only to the respective switching element 45 or 46 but can be activated by all the cars 14 and 16 traveling to the respective shaft door 44. Such a configuration has the advantage that the cars 14 and 16 could have circuits that are electrically separate from one another associated with them.

Figure 3:
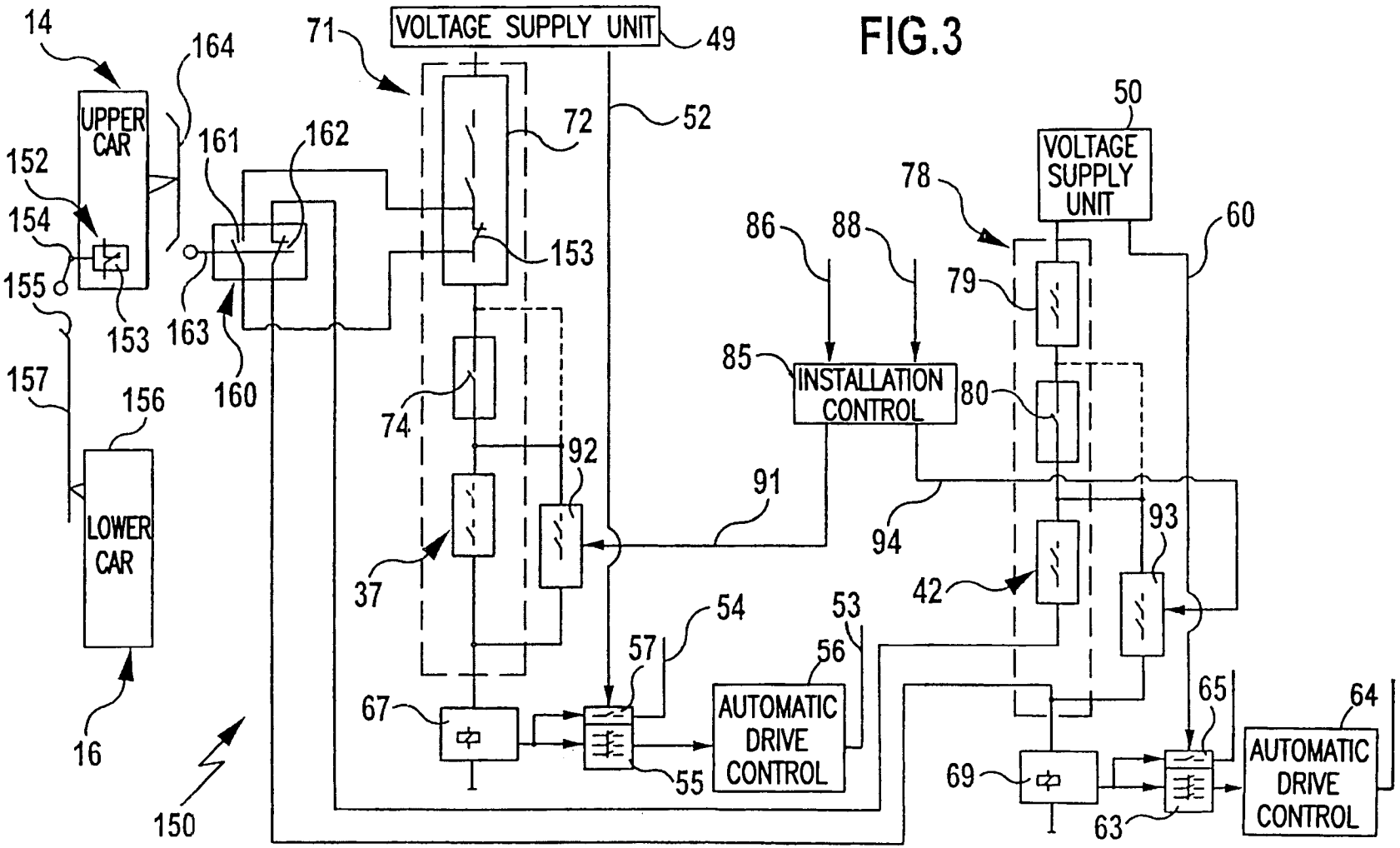
FIG. 3 shows a schematic representation in extract form of a second embodiment of an elevator installation according to the invention.

In FIG. 3, a second embodiment of an elevator installation according to the invention is schematically represented and provided overall with the reference numeral 150. This is configured largely identically to the elevator installation 10 explained above with reference to FIGS. 1 and 2. Therefore, the same reference numerals as in FIGS. 1 and 2 are used for identical components in FIG. 3. To avoid repetition, reference is made in this respect to the full content of the statements made above.

In the case of the elevator installation 150 represented in FIG. 3, the upper car 14 has a proximity switch 152, the switching contacts 153 of which are integrated into the shaft monitoring circuit 72 of the safety chain 71 associated with the upper car 14, the switching contacts 153 being connected in series with further switching contacts, known per se, of the safety circuit 72.

The actuation of the proximity switch 152 takes place by means of a switching roller 154, which is mounted on the outside of the upper car 14 and, when the upper car 14 comes very close to the lower car 16, comes into contact with a switching face 155, which is fixed on a spacer 157 projecting beyond a car roof 156 of the lower car 16.

If the upper car 14 approaches the lower car 16 to such an extent that the switching face 155 of the lower car 16 actuates the switching roller 154, the proximity switch 152 of the upper car 14 is actuated, its switching contacts 153 being opened. This has the consequence that the power supply to the travel contactor 67 of the upper car 14 is interrupted and consequently the travel of the upper car 14 is blocked.

The switching face 155 consequently forms in combination with the switching roller 154 and the associated proximity switch 152 a collision prevention device, with the aid of which collisions of the two cars 14 and 16 can be prevented.

In dependence on, for example, the traffic pattern and/or in dependence on particular circumstances of the building in which the elevator installation 150 is installed, such as for example reduced floor-to-floor distances, in certain cases it may be desired for the two cars 14 and 16 to come very close together. In order to avoid adversely affecting the travel of the two cars 14 and 16 in such a situation, an invalidation element in the form of a bridging module 160, which is mounted in a fixed location in the shaft 12 and has a normally-open contact 161 and a normally-closed contact 162, is used in the case of the elevator installation 150. The bridging module 160 is mounted at a predetermined location within the shaft 12 at which the two cars 14 and 16 are to be allowed to come close together, the normally-open contact 161 being connected in parallel with the switching contacts 153 of the proximity switch 152. For actuation, the bridging module 160 has a switching cam follower 163, which can be actuated by a switching cam 164 fixed on the outside of the upper car 16. If the bridging module 160 is actuated by the switching cam 164 by actuation of the switching cam follower 163, this has the consequence that the normally-open contact 161 is closed and at the same time the normally-closed contact 162 is opened. The normally-closed contact 162 is integrated into the safety chain 78 of the lower car 16 and connected in series with the latter's car-door safety circuit 42. Together with the car-door safety circuit 42, it can be bridged by the second bridging circuit 93.

Consequently, in spite of the use of the proximity switch 152, the upper car 14 can be deliberately made to approach the lower car 16, any adverse effect on the travel of the upper car 14 being prevented, since the switching contacts 153 of the proximity switch 152 are bridged by the closed normally-open contact 161. However, it is ensured by the simultaneous opening of the normally-closed contact 162 that, when the upper car 14 is deliberately made to approach the lower car 16, the travel of the lower car is blocked, since the normally-closed contact 162 is integrated into the safety chain 78 of the lower car 16.

The configuration explained above of the elevator installation 150 makes it possible, for example, for the floor-to-floor distance between the stop 100 situated on the ground floor and the stop 101 situated on the first upper floor to be chosen to be so small that, in the case in which the lower car 16 is at the stop 100, although the proximity switch 152 is actuated when the upper car 14 enters the stop 101, this actuation does not adversely affect the traffic flow. For this purpose, the mounting location of the bridging module 160 within the shaft 12 of the elevator installation 150 is chosen such that, when the car 14 enters the stop 101, the switching cam 164 actuates the switching cam follower 163 of the bridging module 160, so that the then closed normally-open contact 161 bridges the switching contacts 153 of the proximity switch 152 and at the same time the normally-closed contact 162 assumes its open switching position. If the upper car 14 leaves the stop 101 and at the same time the bridging module 160 remains actuated on account of a fault, the normally-closed contact 162 remains in its open position. This has the consequence that the lower car 16 can in fact still move within the stop 100, for example can adjust, as long as both the car safety circuit 42 and the normally-closed contact 162 of the lower car 16 are bridged by the installation control 85 by means of activation of the bridging circuit 93, but that the lower car 16 cannot leave the stop 100 with the intention of traveling to another stop, since in this case the installation control 85 no longer activates the bridging circuit 93 of the lower car 16, whereby the bridging is canceled and consequently the open normally-closed contact 162 interrupts the current flow to the travel contactors 69. This has the consequence of immediately stopping the lower car 16. The travel of the upper car 14 is uninfluenced by this however.

The invention claimed is:

1. Elevator installation with at least one shaft, in which at least two cars disposed one above the other can be made to travel up and down, the shaft having a plurality of shaft doors and the cars respectively comprising at least one car door, and with a safety device for blocking the travel of the cars when the shaft doors or car doors are open, wherein the safety device has at least two independent safety circuits, each having at least one shaft door and/or car door associated with it, it being possible for the travel of at least one car to be blocked by means of the safety circuits.

2. Elevator installation according to claim 1, wherein the shaft has at least one shaft region in which the shaft doors are associated only with one safety circuit.

3. Elevator installation according to claim 1, wherein the shaft has at least one shaft region in which the shaft doors are associated with at least two safety circuits.

4. Elevator installation according to claim 1, wherein the car doors of a car are associated with only one safety circuit.

5. Elevator installation according to claim 1, wherein at least one upper car can be made to travel in an upper shaft region having shaft doors and in that at least one lower car can be made to travel in a lower shaft region having shaft doors, the car doors of the at least one upper car and the shaft doors of the upper shaft region being associated with one or more first safety circuits and the car doors of the at least one lower car and the shaft doors of the lower shaft region being associated with one or more second safety circuits.

6. Elevator installation according to claim 1, wherein at least one safety circuit forms a shaft-door safety circuit that only has shaft doors associated with it, it being possible by means of the shaft-door safety circuit only to block the travel of cars in whose serving region the associated shaft doors are disposed.

7. Elevator installation according to claim 1, wherein at least one safety circuit forms a car-door safety circuit that only has car doors associated with it, it being possible by means of the car-door safety circuit only to block the travel of cars whose car doors are associated with the car-door safety circuit.

8. Elevator installation according to claim 7, wherein each car-door safety circuit respectively has only the car doors of one car associated with it.

9. Elevator installation according to claim 1, wherein at least one safety circuit forms a shaft-door safety circuit that only has shaft doors associated with it, it being possible by means of the shaft-door safety circuit only to block the travel of cars in whose serving region the associated shaft doors are disposed, and wherein at least one safety circuit forms a car-door safety circuit that only has car doors associated with it, it being possible by means of the car-door safety circuit only to block the travel of cars whose car doors are associated with the car-door safety circuit, wherein each car has a single car-door safety circuit and a single shaft-door safety circuit associated with it.

10. Elevator installation according to claim 9, wherein the car-door and shaft-door safety circuits respectively associated with a car have monitoring elements, which are connected in series with one another.

11. Elevator installation according to claim 10, wherein at each shaft door there is disposed for each car traveling to this shaft door an own shaft-door monitoring element.

12. Elevator installation according to claim 6, wherein the travel of a car can be blocked by a shaft-door safety circuit which has associated with it both at least one shaft door that is disposed in the serving region of only this one car and at least one shaft door that is disposed in the serving region of this one car and at least one other car.

13. Elevator installation according to claim 1, wherein, when a car is stopped in the region of a shaft door, the monitoring of the opening and closing state of this shaft door can be disabled.

14. Elevator installation according to claim 13, wherein the monitoring of the opening and closing state can only be disabled in the case of those shaft doors that are disposed in the serving region of at least two cars.

15. Elevator installation according to claim 13, wherein the safety device for monitoring the opening and closing state of the shaft doors and car doors has monitoring elements that respectively interact with a shaft door or car door, the monitoring elements of shaft doors for which the monitoring can be disabled being able to be rendered ineffective by means of bridging units.

16. Elevator installation according to claim 15, wherein the bridging unit has an activating element, which can be actuated by a car stopping at the associated shaft door.

17. Elevator installation according to claim 16, wherein the activating element is configured as a magnetic switch.

18. Elevator installation according to claim 15, wherein the bridging unit can be activated by an installation control of the elevator installation.

19. Elevator installation according to claim 18, wherein the bridging unit can be activated by actuation of its activating element by means of a car only when it is at the same time acted upon by a control signal provided by the installation control.

20. Elevator installation according to claim 6, wherein, when a shaft door is opened without a car being present at the stop corresponding to the shaft door, all the shaft-door safety circuits associated with this stop are responsive.

21. Elevator installation according to claim 9, wherein each car is connected to a separate voltage supply unit, and in that the car-door and shaft-door safety circuits of each car are connected to the respective voltage supply unit of the car, shaft-door safety circuits with shaft doors that are disposed in the serving region of at least two cars being able to be connected to the voltage supply unit of only one of the cars concerned.

22. Elevator installation according to claim 21, wherein the shaft-door safety circuits that have their associated shaft doors disposed in the serving region of a number of cars can be automatically connected in each case to the voltage supply unit of a pre-selected car, as long as this car is in operation.

23. Elevator installation according to claim 1, wherein each car has a shaft monitoring circuit associated with it, by means of which the travel of the car can be blocked in dependence on the state of safety-relevant switching members, at least one switching member having a bridging element associated with it for rendering the switching member ineffective, it being possible for the travel of at least one second car to be blocked when a first car is traveling with an active associated bridging element.

24. Elevator installation according to claim 23, wherein the blockage of the second car can be canceled by means of the installation control.

25. Method for controlling an elevator installation with at least one shaft, in which at least two cars disposed one above the other can be made to travel up and down, the shaft having a plurality of shaft doors and the cars respectively comprising at least one car door, and it being possible for the travel of the cars to be blocked by means of a safety device when the shaft door or car door is open, wherein the travel of each car is separately blocked in dependence on the opening and closing states of its car doors and of all the shaft doors and in dependence on the position of all the cars that can be made to travel along the shaft.

* * * * *